United States Patent [19]

Topits

[11] Patent Number: 4,535,993

[45] Date of Patent: Aug. 20, 1985

[54] PUSH PEG GAME APPARATUS

[76] Inventor: John Topits, P.O. Box 1593, Coos Bay, Oreg. 97420

[21] Appl. No.: 615,651

[22] Filed: May 31, 1984

[51] Int. Cl.[3] ..... A63F 3/00

[52] U.S. Cl. ..... 273/241; 273/265

[58] Field of Search ..... 273/241, 287, 265

[56] References Cited

U.S. PATENT DOCUMENTS

| | | | |
|---|---|---|---|
| 2,905,474 | 9/1959 | Jahr | 273/153 R |
| 3,114,548 | 12/1963 | Taft, Jr. | 273/153 R |
| 3,550,943 | 10/1970 | Hatcher | 273/265 |
| 3,612,537 | 10/1971 | Sato | 273/156 |
| 3,630,525 | 10/1971 | Weisbecker | 273/265 |
| 3,813,099 | 5/1974 | Scott | 273/156 |
| 3,888,487 | 11/1974 | Replogle | 273/241 |
| 4,032,155 | 6/1977 | Thomas | 273/156 |
| 4,129,303 | 10/1978 | Flagg | 273/241 |
| 4,283,055 | 8/1981 | Larsen | 273/160 |

*Primary Examiner*—Richard C. Pinkham
*Assistant Examiner*—Benjamin H. Layno
*Attorney, Agent, or Firm*—Henderson & Sturm

[57] ABSTRACT

A push peg game apparatus (10) comprising a block of material formed into a geometric configuration such as a cube element (14), wherein at least three cube faces (15) are provided with apertures (16) that extend into, and intersect with one another at an angle of 90° within the cube element (14), wherein each of the apertures form elongated holes (17) that are dimensioned to receive one of a plurality of elongated peg elements (13).

14 Claims, 6 Drawing Figures

FIG. 1.
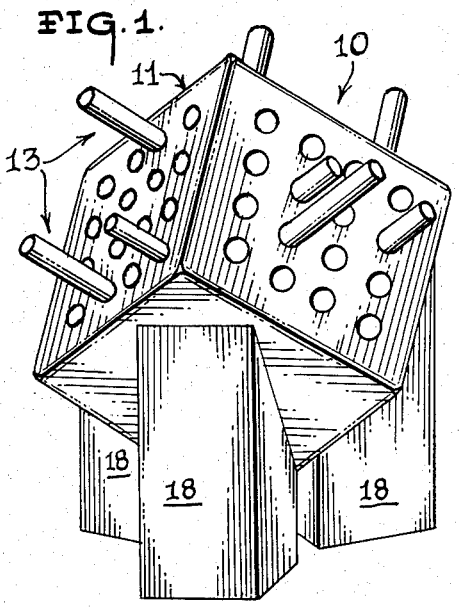
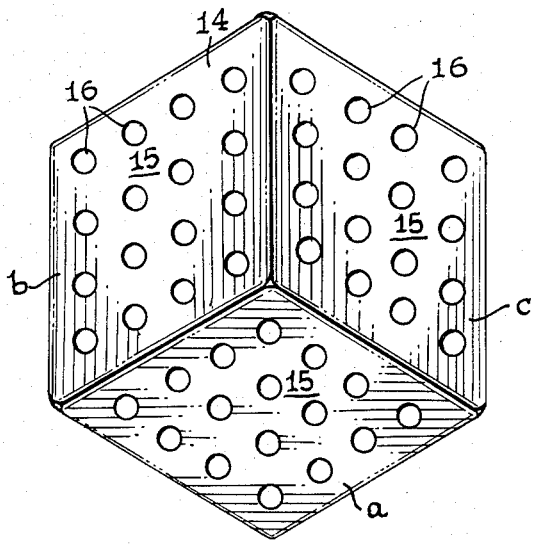
FIG. 2.
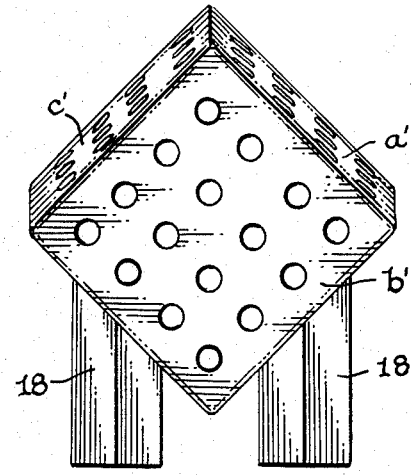
FIG. 3.
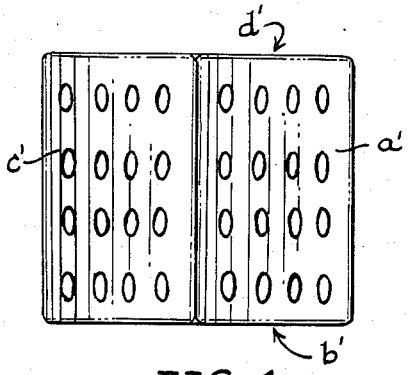
FIG. 4.
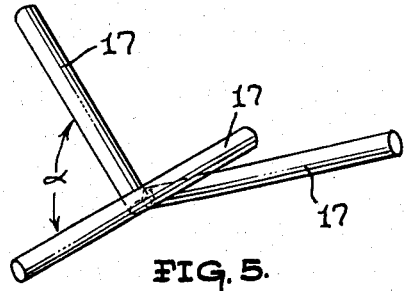
FIG. 5.
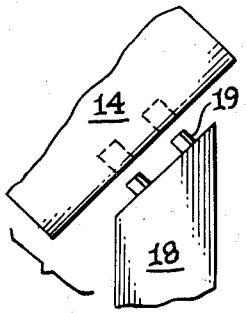
FIG. 6.

PUSH PEG GAME APPARATUS

TECHNICAL FIELD

This invention relates generally to push peg game structures and more specifically to multi-apertured structures that are adapted to receive push pegs from a variety of angles.

BACKGROUND ART

The prior art is replete with various kinds of push peg games, wherein a plurality of pegs are inserted into a plurality of apertures formed on one or more surfaces, with the object of the game being related to the degree of penetration of the various pegs through the surface or surfaces.

Some of the prior art peg receiving structures allow peg penetration in only one plane.

Other prior art peg receiving structures allow peg penetration in a variety of planes.

Most of the aforementioned peg receiving structures are circular in configuration, while some have cylindrical configurations, and other have square configurations.

Representative examples of the aforementioned prior art structures may be seen by reference to the following U.S. Pat. Nos.: 2,905,474; 3,114,548; 3,813,099; and 3,612,537.

While all of the prior art devices are adequate for their intended purposes (i.e.) the amusement of children, the creation of a game or puzzle, etc.); they are deficient in the following areas: the number of people that may partake in the game; the degree of difficulty in mastering the game or puzzle; and, the player produced strategy required to maintain interest in the game by older age groups.

DISCLOSURE OF THE INVENTION

The above stated problems are substantially resolved by the provision of the instant invention. The instant invention includes generally an apertured unit, a support unit and a plurality of peg elements.

The apertured unit comprises a multi-apertured structure wherein a plurality of apertures are formed in at least three distinct portions of the structure, and the apertures from each distinct portions intersect one another at an angle of 90°.

The support unit comprises support means that elevate and dispose the apertured unit such that only one of the distinct portions of the apertured unit is clearly visible to a player during the game.

The plurality of push pegs comprise a plurality of pegs that are color coded (or otherwise designated) into groups of pegs, wherein the number of groups equals the number of distinct portions of the playing surface involved in the game.

BRIEF DESCRIPTION OF THE DRAWINGS

These and other objects, attributes, advantages and novel features of the invention will become more clear upon a thorough study of the following description of the best mode for carrying out the invention, particularly when reviewed in conjunction with the drawings wherein:

FIG. 1 is a perspective view of the three player version of the invention;

FIG. 2 is a top plan view of the three sided version of the invention;

FIG. 3 is a perspective view of the four sided version of the invention;

FIG. 4 is a top plan view of the four sided version of the invention;

FIG. 5 is a detailed view of the angle of intersection of the apertures formed thru the various surfaces of the apertured unit; and FIG. 6 is a detailed view of the cooperation between the apertured unit and a support unit.

BEST MODE FOR CARRYING OUT THE INVENTION

Referring now to the drawings, and in particular to FIG. 1, the apparatus may be seen as depicted generally by the numeral 10. The apparatus (10) includes generally an apertured unit (11), a support unit (12) and a plurality of elongated peg elements (13). Each of these units will now be described in seriatim fashion.

The apertured unit (11) comprises a block of material formed into a geometric configuration such as a cube element (14), wherein at least three of the cube faces (15) are provided with an equal number (n) of a plurality of apertures (16) formed on each face (15). Each of the apertures (16) is formed by drilling a elongated hole (17) in the cube element (14), perpendicular to the cube face (15) on which the aperture (16) is disposed. In addition each elongated hole (17) is dimensioned to receive at least one elongated peg element (13).

As shown in the drawings, the apertured faces (15) of the cube element (14) are each provided with an identical number (n) of apertures (16) arranged in a pattern. The drawings show sixteen apertures arranged in four parallel rows of four evenly spaced apertures per row; however, this pattern and number (n) of apertures is for illustration purposes only, and it is to be understood that both the pattern and number (n) of apertures may vary. It should further be noted that while the pattern and number (n) of apertures may vary between different cubes elements (14), the pattern and number (n) of apertures on the apertured faces (15) of any given cube will be identical.

Prior to describing the three player version of the game illustrated in FIGS. 1 and 2, and the four player version of the game illustrated in FIGS. 3 and 4; it should be noted that the elongated holes (17) formed by the apertures (16) may extend either completely or substantially, through the cube element (14). Furthermore, in certain instances, some of the elongated holes (17) would extend completely through the cube element (14) while others would extend, proximate to, but spaced from, the cube face diametrically opposed to the apertured cube face.

The three player version of the game, illustrated in FIGS. 1 and 2, comprises a cube element (14) having at least three apertured cube faces (15). In addition the cube element (14) is provided with a support unit (14) that comprises support means in the form of a plurality of support legs (18) that engage the remaining three (apertured or unapertured) cube faces (15), to dispose at least three apertured cube faces (15) on the top portion of the cube element (14).

As can be seen from the drawings, this arrangement produces three distinct upwardly facing apertured playing surface portions designated generally as (a,b,c). In addition, the three distinct playing surface portions are disposed in such a manner that a player facing one playing surface (for example a) cannot readily observe the other two playing surfaces (b) and (c).

The four player version of the game, illustrated in FIGS. 3 and 4, comprises a cube element (14) having at least four apertured cube faces (15). As in the three player version, the cube element (14) is provided with a support unit (12) that also comprises support means in the form of a plurality of support legs (18) that engage the remaining two cube faces (15), to dispose two of the apertured cube faces on top of the cube element (14), and two of the apertured cube faces on the sides of the cube element.

In this version there are four distinct apertured playing surface portions designated generally as a', b', c' and d'. In addition, the four distinct playing surface portions are disposed with respect to one another so that a player facing one playing surface (e.g. a') cannot readily observe the other three playing surfaces (b', c', and d').

As mentioned supra the cube elements (14) for the three and four player versions of the game may be manufactured having only three apertured faces or only four apertured faces respectively. In those instances, the plurality of support legs (18) will either be rigidly secured to the unapertured cube faces (15) that they contact, or they will be rigidly secured to one another, to form a support means that the cube element (14) will merely rest upon.

It should also be noted that the cube element may be manufactured by having apertures formed through all six of the cube faces. In this instance, as shown in FIG. 6, the support legs (18) would be provided with a plurality of small projections (19) that would cooperate with the apertures (16) on the supported cube faces (15), to releasably secure the cube element (14) to the plurality of support legs (18). These support legs (18) could also be interchangeable between the three player version; wherein three support legs (18) would be required for the three player version, and only two support legs (18) would be required for the four player version.

As shown in FIG. 3, each of the elongated holes (17) formed through one of the apertured faces (15) intersects at a plurality of points, the elongated holes (17) formed through at least two of the remaining apertured faces, and each of the elongated holes (17) from the respective faces are disposed at an angle "$\alpha$" with respect to the holes (17) from the other faces. In the versions illustrated "$\alpha$" has a value of 90°, although it is conceivable that $\alpha$ could have values other than 90°.

As mentioned supra the plurality of elongated pegs are divided into groups of pegs, wherein the number of groups of pegs equals the number of distinct playing surface portions involved in the aforementioned versions of the game. Both the faces of the cube and the groups of pegs may be color coded, or otherwise designated, to relate a group of pegs to a given cube face. In addition the total number (m) of pegs in any group of pegs, will be less than the total number (n) of apertures in any apertured cube face.

The basic object of this game is for each player to insert as many pegs (13) on each playing surface portion as far as they can into the cube element (17), until the pegs (13) contact other pegs (13) inserted from the other playing surfaces, or the travel of the pegs is otherwise limited by the construction of the cube element (14).

A brief description of the rules of the game are as follows:

The object of the game is to get 5 of your pegs in all the way or to capture 5 opponents pegs. To begin each player chooses 10 pegs of the same color. Flip a coin to determine who plays first. Play passes to the left.

To play put a peg in any hole in the block as far as it will go. If you start a peg in a hole you must put it in that hole. If the end of the peg you just put in touches an opponents peg and you already have the end of one or more of your pegs touching that peg you may remove (capture) it. After removing opponents you must push all pegs in as far as they will go. If there is a choice of which peg to push in first, you may make that choice.

Only one capture per turn is allowed if any player is out of pins when it is their turn, the game ends and the player with the highest score wins.

A series of games may also be played. At the end of each game score 1 point for each peg in all the way and 1 point for each peg captured. The series ends when the score reaches 25 and the player with the highest score wins.

It should be appreciated at this point that a game constructed in accordance with the above teachings will produce an entirely new 3-dimensional game involving strategical spatial relationships. In addition, the game will on one hand be easy to learn, and yet on the otherhand be a challenge to master.

Obviously, many substitutions, modifications and variations of the present invention are possible in light of the above teachings. It is therefore to be understood, that within the scope of the appended claims, the invention may be practiced otherwise than as specifically described.

What I claim is:

1. A push peg game apparatus comprising a block of material formed into a geometric configuration having at least three distinct playing surfaces, wherein each of said distinct playing surfaces is provided with an equal number (n) of a plurality of apertures and each aperture defines the opening of an elongated hole formed in the block of material, wherein the elongated holes extending from the at least three distinct playing surfaces intersect one another at an angle of $\alpha$; and a plurality of elongated pegs divided into at least three distinct groups of pegs, wherein the number (m) of pegs in each group is less than the number (n) of apertures in each distinct playing surface.

2. An apparatus as in claim 1; wherein, the geometric configuration is in the form of a cube element.

3. An apparatus as in claim 2; further comprising support means for elevating and orientating the cube element in various positions.

4. An apparatus as in claim 3; wherein, the support means comprises a plurality of support legs.

5. An apparatus as in claim 4; wherein, the said elongated holes extend completely through the cube element forming an equal number (n) of apertures on each of the six faces of the cube element.

6. An apparatus as in claim 5; wherein each of the plurality of support legs is provided with a plurality of small projections that are adapted to be received within the apertures on any one of the six faces of the cube element.

7. An apparatus as in claim 1; wherein, the value of $\alpha$ is 90°.

8. A push peg game apparatus comprising a block of material formed into a geometric configuration having at least four distinct playing surfaces, wherein each of said distinct playing surfaces is provided with an equal number (n) of a plurality of apertures and each aperture defines the opening of an elongated hole formed in the block of material, wherein the elongated holes extending from three of the at least four distinct playing surfaces intersect one another at an angle of $\alpha$; and a plurality of elongated pegs divided into at least four distinct groups of pegs, wherein the number (m) of pegs in each group is less than the number (n) of apertures in each distinct playing surface.

9. An apparatus as in claim 8; wherein, the geometric configuration is in the form of a cube element.

10. An apparatus as in claim 9; further comprising support means for elevating and orientating the cube element in various positions.

11. An apparatus as in claim 10; wherein, the support means comprises a plurality of support legs.

12. An apparatus as in claim 11; wherein, the said elongated holes extend completely through the cube element forming an equal number (n) of apertures on each of the six faces of the cube element.

13. An apparatus as in claim 12; wherein each of the plurality of support legs is provided with a plurality of small projections that are adapted to be received with the apertures on any one of the six faces of the cube element.

14. An apparatus as in claim 8; wherein, the value of $\alpha$ is 90°.

* * * * *